US005209018A

United States Patent [19]

Heinrich

[11] Patent Number: 5,209,018

[45] Date of Patent: May 11, 1993

[54] SLIDING PATIO DOOR IMPROVEMENT

[76] Inventor: William I. Heinrich, 1249 Cloverwood Dr., Webster, N.Y. 14580

[21] Appl. No.: 862,614

[22] Filed: Mar. 12, 1992

[51] Int. Cl.[5] ..... E06B 3/00

[52] U.S. Cl. ..... 49/449; 411/347; 52/207

[58] Field of Search ..... 411/343, 347, 554, 555, 411/350; 49/406, 449, 503; 403/348, 349; 52/206, 207

[56] References Cited

U.S. PATENT DOCUMENTS

| | | | |
|---|---|---|---|
| 2,721,361 | 10/1955 | Ryan et al. | 52/207 |
| 2,721,636 | 10/1955 | Ordorica et al. | 52/207 |
| 3,052,942 | 9/1962 | Mulvaney | 411/347 X |
| 3,111,727 | 11/1963 | Gerecke | 52/207 |
| 3,827,184 | 8/1974 | Pennec et al. | 49/449 |
| 4,532,743 | 8/1985 | Miller et al. | 49/449 X |

FOREIGN PATENT DOCUMENTS

| | | | |
|---|---|---|---|
| 766082 | 8/1967 | Canada | 411/347 |
| 1397861 | 6/1975 | United Kingdom | 411/347 |

*Primary Examiner*—Peter M. Cuomo
*Assistant Examiner*—Jerry Redman
*Attorney, Agent, or Firm*—Robert J. Bird

[57] ABSTRACT

A sliding patio door includes a movable panel and a stationary panel, the panels including vertical frame members which overlap when the door is closed. A bolt through one of the vertical frame members engages a nut in the other vertical frame member when the door is closed to draw the frame members together, eliminating clearance between them and locking the panels together against horizontal and vertical movement. The bolt is engaged and disengaged by 90° rotation. When the bolt is disengaged, a captured compression spring keeps it at its open position for convenience.

4 Claims, 1 Drawing Sheet

SLIDING PATIO DOOR IMPROVEMENT

FIELD OF THE INVENTION

This invention is a sliding patio door with provision for sealing the closed door against draft and locking it against horizontal and vertical movement.

BACKGROUND INFORMATION

Sliding patio doors typically include a stationary panel and a horizontally movable panel, each including a surrounding frame. The frames are spaced one behind the other to permit sliding of one relative to the other. Spacing is necessary for sliding, but is detrimental to effective closure of the door, and so these doors usually are not as airtight or weathertight as desired. The conventional solution to this is weather stripping on one or both frame members along the length of their juncture. This has been only a partial solution.

In addition to spacing of the panels required for slidability, the frame members are, over time, subject to warping or other deflection from weight of the glass or other causes. This can aggravate the already the already inherent tendency for these doors to leak air. Where warping is involved, weather stripping, especially if it is originally installed weather stripping, is of little or no effect and can be remedied only by supplemental weather stripping put on over the old, or new weather stripping put on in its place.

The alternative to weather stripping to improve the airtight effectiveness of sliding doors is to minimize or eliminate the clearance between panels when the door is closed. U.S.Pat. No. 3,060,487 to Baiter discloses a sliding window arrangement having a contact member which pushes one window panel in against the other where they overlap. To exert this push, the contact member must of necessity be mounted on a support or frame external of the window panel themselves. The device is therefore limited to use at the top or bottom of the window, and does not produce effective closure between top and bottom.

The movable panel of a patio door slides back and forth on tracks within a frame. Clearance between the movable panel and the top of the frame allows for installation and removal of the panel. This is a potential security problem because burglars and thieves can also remove the movable panel.

One object of this invention is to provide a positive clamping of one patio door panel to the other at one or more points between top and bottom to enhance the airtight effectiveness of the door.

Another object is to provide positive locking of the panel of a patio door to prevent their disengagement by either horizontal or vertical movement.

Another object is to provide such a locking system which is capable of simple retro-installation.

SUMMARY OF THE INVENTION

The present invention is a sliding patio door with a movable panel and a stationary panel, the panels including vertical frame members which overlap when the door is closed. A bolt through one of the vertical frame members engages a nut in the other vertical frame member when the door is closed to draw the frame members together, eliminating clearance between them and locking the panels together against horizontal and vertical movement. The bolt is engaged and disengaged by 90° rotation. When the bolt is disengaged, a captured compression spring keeps it at its open position for convenience.

DRAWING

DESCRIPTION

Figure 1:
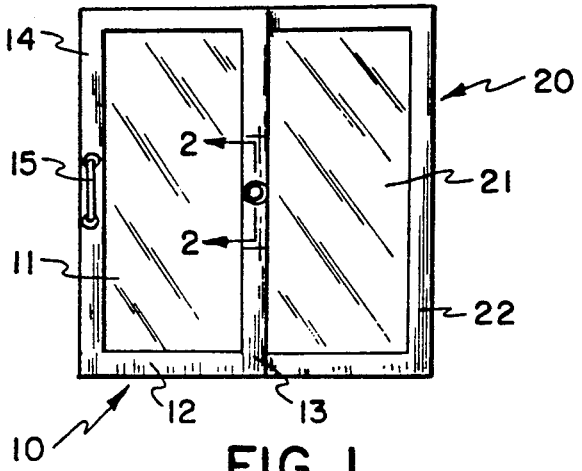
FIG. 1 is an elevation view of a patio door.
Figure 4:
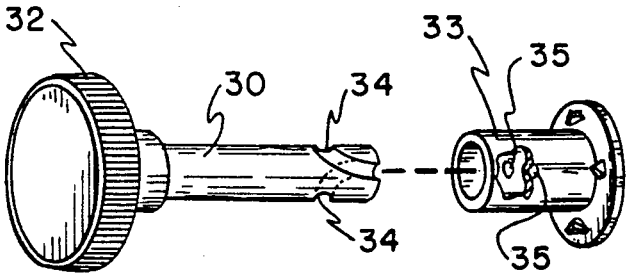
FIG. 4 is a detail view of the nut and bolt from FIGS. 2 and 3.

Referring to FIG. 1, a sliding patio door includes a horizontally movable panel 10 in the foreground, and a stationary panel 20 immediately behind it. The movable panel 10 includes a pane of glass 11 mounted in a wood or metal frame 12. The frame 12 includes a right vertical frame member 13 and a left vertical frame member 14. The left vertical member 14 includes a handle 15. The stationary panel 20 includes a glass pane 21 in a frame 22. The left vertical member of frame 22 is indicated at 23. The movable panel 10 slides in front of the stationary panel 20 on suitable top and bottom tracks, not shown. In FIG. 1, the patio door is closed and the right vertical frame member 13 of the movable panel 10 is directly in line with the left vertical frame member 23 of the stationary panel 20.

Figure 2:
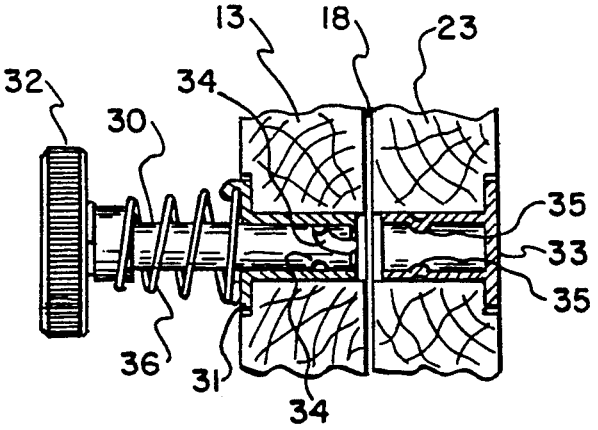
FIG. 2 is an enlarged transverse section on the plane 2—2 of FIG. 1.

There is necessarily a clearance 18, however small, between the frames 12 and 22 to facilitate movement of the panel 10 relative to the stationary panel 20. The clearance 18 is represented in FIG. 2 between the vertical frame member 13 of the movable panel and the vertical frame member 23 of the stationary panel. In operative condition represented in FIG. 2, the frame member 13 with panel is free to move relative to the frame member 23 and stationary panel 20. In this condition, the vertical frame members do not form an airtight juncture.

A bolt extends through a sleeve 31 in the vertical frame member 13 of the movable panel 10. The bolt 30 includes a handle 32 suitable for gripping and turning by hand. A mating T-nut 33 is mounted in the vertical frame member 23 of the stationary panel 20. The bolt 30 includes grooves 34 of helical or other curvature. The T-nut 33 includes corresponding projections 35 to engage the grooves 34. I prefer a configuration of the grooves 34 as illustrated to facilitate quick locking and unlocking action with a 90° turn of the bolt. A compression spring 36 surrounds the bolt 30 and is captured in place between the sleeve 31 and handle 32.

In FIG. 2 the bolt 30 is partially withdrawn through its sleeve 31 and from engagement with the frame member 23 and nut 33, and the panel 10 is free to move in normal operation of the door. The compression spring 36 pushes the bolt 30 to this position when it is not engaged with the nut 33.

Figure 3:
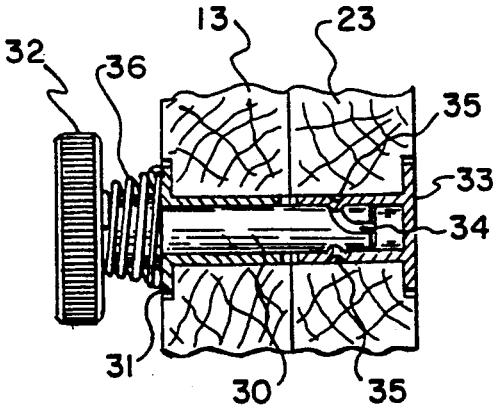
FIG. 3 is similar to FIG. 2, showing the door panels drawn together.

In FIG. 3, the bolt 30 is pushed in against the compression spring 36 and into engagement with the nut 33. The frame members 13 and 23 drawn together by engagement of the bolt 30 and nut 33. The clearance 18 is now closed and the door is substantially airtight and weathertight.

In addition to closing the clearance 18, the bolt 30 and nut 33 lock the frame members 13 and 23 together. This locks the door preventing normal horizontal movement of the panel 10. It also locks both panels together preventing vertical movement of the panel 10 so it cannot be lifted out of engagement with its tracks. This system thus provides not only improved airtight to the sliding patio door, but also a type of security not heretofore provided by the typical patio door lock.

This locking system also gives the door panels added stability against high winds and wind gusts. The sleeve 31 and T-nut 33, and associated parts are as easily installated on an existing door as on a door process of manufacture. As illustrated in FIG. 1, the bolt 30 and nut 33 are mounted in the door panels at about mid height. If more than one bolt 30 and nut 33 are to be used, as might be the case with very high doors for example, the bolts and nuts would be spaced accordingly from top to bottom.

The foregoing description of a preferred embodiment of this invention is intended as illustrative. The concept and scope of the invention are limited only by the following claims and equivalents thereof.

What is claimed is:

1. A sliding patio door including a stationary panel with a vertical frame member, and a horizontally movable panel with a vertical frame member, said vertical frame members overlapping each other when said door is closed;

a rotatable and axially movable bolt extending transversely through the vertical frame member of said movable panel at a central location between the top and bottom thereof; and a nut disposed in the vertical frame member of said stationary panel;

said bolt engaging said nut when said door is closed to pull said vertical frame members together to eliminate clearance therebetween, and to lock said panels together to prevent both horizontal and vertical movement of said movable panel.

2. A sliding patio door as defined in claim 1 in which said bolt and nut are engaged and disengaged by a 90° rotation of said bolt.

3. A sliding patio door as defined in claim 1, further including a compression spring surrounding said bolt inward of said handle to urge said bolt clear of said stationary panel.

4. A sliding patio door as defined in claim 3, in which said compression spring is connected to said bolt and to said movable vertical frame member.

* * * * *